US007901262B2

(12) United States Patent
Satoh

(10) Patent No.: US 7,901,262 B2
(45) Date of Patent: Mar. 8, 2011

(54) SPARK PLUG MANUFACTURING METHOD ENSURING ACCURATE AND EFFECTIVE ADJUSTMENT OF SPARK GAP

(75) Inventor: Yoshio Satoh, Kuwana-shi (JP)

(73) Assignee: Denso Corporation, Kariya (JP)

( * ) Notice: Subject to any disclaimer, the term of this patent is extended or adjusted under 35 U.S.C. 154(b) by 301 days.

(21) Appl. No.: 12/172,496

(22) Filed: Jul. 14, 2008

(65) Prior Publication Data

US 2009/0017712 A1 Jan. 15, 2009

(30) Foreign Application Priority Data

Jul. 12, 2007 (JP) ..... 2007-182930

(51) Int. Cl.
*H01T 21/02* (2006.01)

(52) U.S. Cl. ..... 445/7; 445/4

(58) Field of Classification Search ..... 445/7, 4; 313/118, 143; 123/143, 169 R
See application file for complete search history.

(56) References Cited

U.S. PATENT DOCUMENTS

| | | | |
|---|---|---|---|
| 5,741,963 | A | 4/1998 | Nakatani et al. |
| 6,193,575 | B1 | 2/2001 | Nakatani |
| 6,589,091 | B2 | 7/2003 | Harada |
| 6,603,246 | B2 | 8/2003 | Hori |
| 6,893,310 | B2 | 5/2005 | Nakatani |
| 7,021,980 | B2 | 4/2006 | Hanai |
| 7,043,813 | B2 | 5/2006 | Hanai |
| 7,097,525 | B2 | 8/2006 | Oda et al. |
| 2005/0039332 | A1 | 2/2005 | Oda et al. |

FOREIGN PATENT DOCUMENTS

| | | |
|---|---|---|
| JP | 3-64882 | 3/1991 |
| JP | 8-153566 | 6/1996 |
| JP | 11-121144 | 4/1999 |
| JP | 2000-164322 | 6/2000 |
| JP | 2000-200670 | 7/2000 |
| JP | 2001-307857 | 11/2001 |
| JP | 2002-164149 | 6/2002 |
| JP | 2002-216931 | 8/2002 |
| JP | 2004-134136 | 4/2004 |
| JP | 2004-146101 | 5/2004 |
| JP | 2005-63893 | 3/2005 |
| JP | 2005-100938 | 4/2005 |

*Primary Examiner* — Bumsuk Won
*Assistant Examiner* — Elmito Breval
(74) *Attorney, Agent, or Firm* — Nixon & Vanderhye PC

(57) ABSTRACT

A method of manufacturing a spark plug includes the step of adjusting a spark gap in the spark plug. In the step, a ground electrode is repeatedly pressed, by a hammer, toward a center electrode. The hammer operates in a first mode when the size of the spark gap falls in a rough-process range which is above a predetermined value, and in a second mode when the size of the spark gap falls in a finish-process range which is between the predetermined value and a target value less than the predetermined value. The amount of pressing the ground electrode in any press stroke of the hammer in the second mode is less than that in any press stroke of the hammer in the first mode. The amount of pressing the ground electrode in every press stroke of the hammer in the second mode is equal to a fixed value.

8 Claims, 10 Drawing Sheets

START
S1
MOVE HAMMER TO INITIAL HEIGHT
S2
DETERMINE Qn
S3
DETERMINE Gn
S4
PRELIMINARY PROCESS
S5
RETURN HAMMER TO Qn
S6
DETERMINE Qn
S7
DETERMINE Gn
S8
S9
IS Gn IN RANGE B ?
NO
YES
S12
Gn REACHED G0 ?
YES
NO
PRESS GROUND ELE. BY Kb
S13
RETURN HAMMER TO Qn
S14
DETERMINE Qn
S15
DETERMINE Gn
S16
S17
Gn REACHED G0 ?
NO
YES
RETURN HAMMER TO INITIAL HEIGHT
S18
END
S19
PRESS GROUND ELE. BY Ka
S10
RETURN HAMMER TO Qn
S11

SPARK PLUG MANUFACTURING METHOD ENSURING ACCURATE AND EFFECTIVE ADJUSTMENT OF SPARK GAP

CROSS-REFERENCE TO RELATED APPLICATION

This application is based on and claims priority from Japanese Patent Application No. 2007-182930, filed on Jul. 12, 2007, the content of which is hereby incorporated by reference in its entirety into this application.

BACKGROUND OF THE INVENTION

1. Technical Field of the Invention

The present invention relates generally to methods of manufacturing spark plugs for use in internal combustion engines of, for example, motor vehicles and cogeneration systems. More particularly, the invention relates to a method of manufacturing a spark plug for an internal combustion engine, which ensures an accurate and effective adjustment of a spark gap in the spark plug.

2. Description of the Related Art

In manufacturing a spark plug for an internal combustion engine, it is necessary to adjust the spark gap between a pair of center and ground electrodes of the spark plug. Further, to adjust the spark gap, the ground electrode is generally pressed and bent toward the center electrode. Since the ground electrode generally springs back after being pressed, it is necessary to perform the press while taking into account the amount of springback of the ground electrode. However, the amount of springback of the ground electrode is unique to each spark plug. In other words, the amounts of springback of ground electrodes vary among individual spark plugs. Therefore, if the amount of springback was not suitably taken into account, it would be difficult to define a desired spark gap for each individual spark plug.

Japanese Patent First Publication No. 2000-164322 discloses a method of manufacturing a spark plug, according to which: the amount of springback of the ground electrode to be made by a regular press is first estimated based on the amount of springback of the ground electrode made by a test press; then the regular press is performed to bend the ground electrode by an amount that is determined based on the estimated amount of spring back of the ground electrode. However, with this method, since there is no fixed relationship between the amounts of springback of the ground electrode made by the test and regular presses, the actual amount of springback of the ground electrode made by the regular press does not always agree with the estimated amount.

Japanese Patent First Publication No. H11-121144 discloses a method of manufacturing a spark plug, according to which: preliminary strikes are first made against the ground electrode; the reduction in the spark gap by the preliminary strikes are measured; the number and/or force of finishing strikes required to bring the size of the spark gap into agreement with a target valve are determined based on the reduction in the spark gap by the preliminary strikes; then the finishing strikes are made in accordance with the determined number and/or force of finishing strikes. However, with this method, since there is no fixed relationship between the reductions in the spark gap by a preliminary and a finishing strike, the size of the spark gap cannot always be brought into agreement with the target value.

Japanese Patent First Publication No. H3-64882 discloses a device for forming a spark gap in a spark plug, which repeatedly presses the ground electrode while measuring the spark gap. With this device, however, the ground electrode is pressed, each press stroke by a fixed amount that is determined by taking into account the amount of springback of the ground electrode, until the size of the spark gap is decreased below a target value. Therefore, when the amount of springback of the ground electrode varies among individual spark plugs, the spark gap may be formed too small in some spark plugs.

Japanese Patent First Publication No. H8-153566, an English equivalent of which is U.S. Pat. No. 5,741,963, discloses an adjustor for adjusting a spark gap in a spark plug. The adjustor bends the ground electrode by means of a hammering device so as to minimize the amount of springback of the ground electrode. However, with this adjustor, the number of hammerings is determined based only on the size of the spark gap measured prior to the adjustment. Consequently, when the amount of springback of the ground electrode varies among individual spark plugs, the spark gap also varies among the individual spark plugs.

SUMMARY OF THE INVENTION

The present invention has been made in view of the above-mentioned problems.

It is, therefore, a primary object of the present invention to provide a method of manufacturing a spark plug for an internal combustion engine, which ensures an accurate and effective adjustment of a spark gap in the spark plug.

According to the present invention, there is provided a first method of manufacturing a spark plug for an internal combustion engine. The first method includes the steps of: (a) preparing a tubular metal shell, an insulator, a center electrode, and a ground electrode; (b) assembling the metal shell, the insulator, and the center and ground electrodes together, so that the metal shell holds therein the insulator, the center electrode is secured in the insulator, and the ground electrode is fixed to the metal shell to form a spark gap between the center and ground electrodes; and (c) adjusting the spark gap to bring the size of the spark gap into agreement with a target value. Further, in the step (c), the ground electrode is repeatedly pressed, by a hammer, toward the center electrode from a state where the size of the spark gap is greater than a predetermined value that is greater than the target value. The hammer operates in a first mode when the size of the spark gap falls in a rough-process range which is above the predetermined value, and in a second mode when the size of the spark gap falls in a finish-process range which is between the target value and the predetermined value. The amount of pressing the ground electrode in any press stroke of the hammer in the second mode is less than the amount of pressing the ground electrode in any press stroke of the hammer in the first mode. Furthermore, the amount of pressing the ground electrode in every press stroke of the hammer in the second mode is equal to a fixed value.

With the above first method, when the size of the spark gap is in the rough-process range, it is possible to deform the ground electrode each press stroke by a large amount, thereby bringing the size of the spark gap into the finish-process range with a small number of reciprocations of the hammer. Moreover, after the size of the spark gap has reached the finish-process range, it is possible to allow the size of the spark gap to gradually approach the target value, thereby preventing the size of the spark gap from being decreased below the target value too much. Further, in the second mode, the hammer repeatedly presses the ground electrode each press stroke by the fixed amount. Therefore, even if the size of the spark gap was decreased below the target value by the last press stroke and the amount of springback of the ground electrode was zero, the final size of the spark gap would deviate from the target value by the fixed amount at the maximum. Accordingly, even when the amount of springback of the ground electrode varies among individual spark plugs, it is still possible to effectively minimize the variation in spark gap size among those spark plugs, thereby accurately and effectively adjusting the spark gap in each individual spark plug.

According to the present invention, there is also provided a second method of manufacturing a spark plug for an internal combustion engine. The second method includes the steps of: (a) preparing a tubular metal shell, an insulator, a center electrode, and a ground electrode; (b) assembling the metal shell, the insulator, and the center and ground electrodes together, so that the metal shell holds therein the insulator, the center electrode is secured in the insulator, and the ground electrode is fixed to the metal shell to form a spark gap between the center and ground electrodes; and (c) adjusting the spark gap to bring the size of the spark gap into agreement with a target value. Further, in the step (c), the ground electrode is repeatedly pressed, by a hammer, toward the center electrode from a state where the size of the spark gap is greater than a predetermined value that is greater than the target value. The hammer operates in a first mode when the size of the spark gap falls in a rough-process range which is above the predetermined value, and in a second mode when the size of the spark gap falls in a finish-process range which is between the target value and the predetermined value. The amount of pressing the ground electrode in any press stroke of the hammer in the second mode is less than the amount of pressing the ground electrode in any press stroke of the hammer in the first mode. Furthermore, the difference between the closest positions of the ground electrode to the center electrode in every two consecutive press strokes of the hammer in the second mode is equal to a fixed value.

With the above second method, when the size of the spark gap is in the rough-process range, it is possible to deform the ground electrode each press stroke by a large amount, thereby bringing the size of the spark gap into the finish-process range with a small number of reciprocations of the hammer. Moreover, after the size of the spark gap has reached the finish-process range, it is possible to allow the size of the spark gap to gradually approach the target value, thereby preventing the size of the spark gap from being decreased below the target value too much. Further, in the second mode, the hammer repeatedly presses the ground electrode such that the difference between the closest positions of the ground electrode to the center electrode in every two consecutive press strokes is equal to the fixed value. Consequently, even if the size of the spark gap was decreased below the target value by the last press stroke and the amount of springback of the ground electrode was zero, the final size of the spark gap would deviate from the target value only by a limited value. Accordingly, even when the amount of springback of the ground electrode varies among individual spark plugs, it is still possible to effectively minimize the variation in spark gap size among those spark plugs, thereby accurately and effectively adjusting the spark gap in each individual spark plug.

According to a further implementation of the invention, in both the first and second modes, the hammer is returned, after each press stroke, to a return position; all the return positions of the hammer are different from one another.

Preferably, the return position of the hammer after each press stroke is set to the position of a pressed surface of the ground electrode before the press stroke.

In each press stroke of the hammer in the first mode, the amount of pressing the ground electrode may be set in proportion to the difference between the size of the spark gap at the start of the press stroke and the target value.

Otherwise, the difference between the closest positions of the ground electrode to the center electrode in every two consecutive press strokes of the hammer in the first mode may be set in proportion to the difference between the size of the spark gap at the start of the latter one of the two consecutive press strokes and the target value.

BRIEF DESCRIPTION OF THE DRAWINGS

The present invention will be understood more fully from the detailed description given hereinafter and from the accompanying drawings of preferred embodiments of the invention, which, however, should not be taken to limit the invention to the specific embodiments but are for the purpose of explanation and understanding only.

In the accompanying drawings.

DESCRIPTION OF PREFERRED EMBODIMENTS

Figure 1:
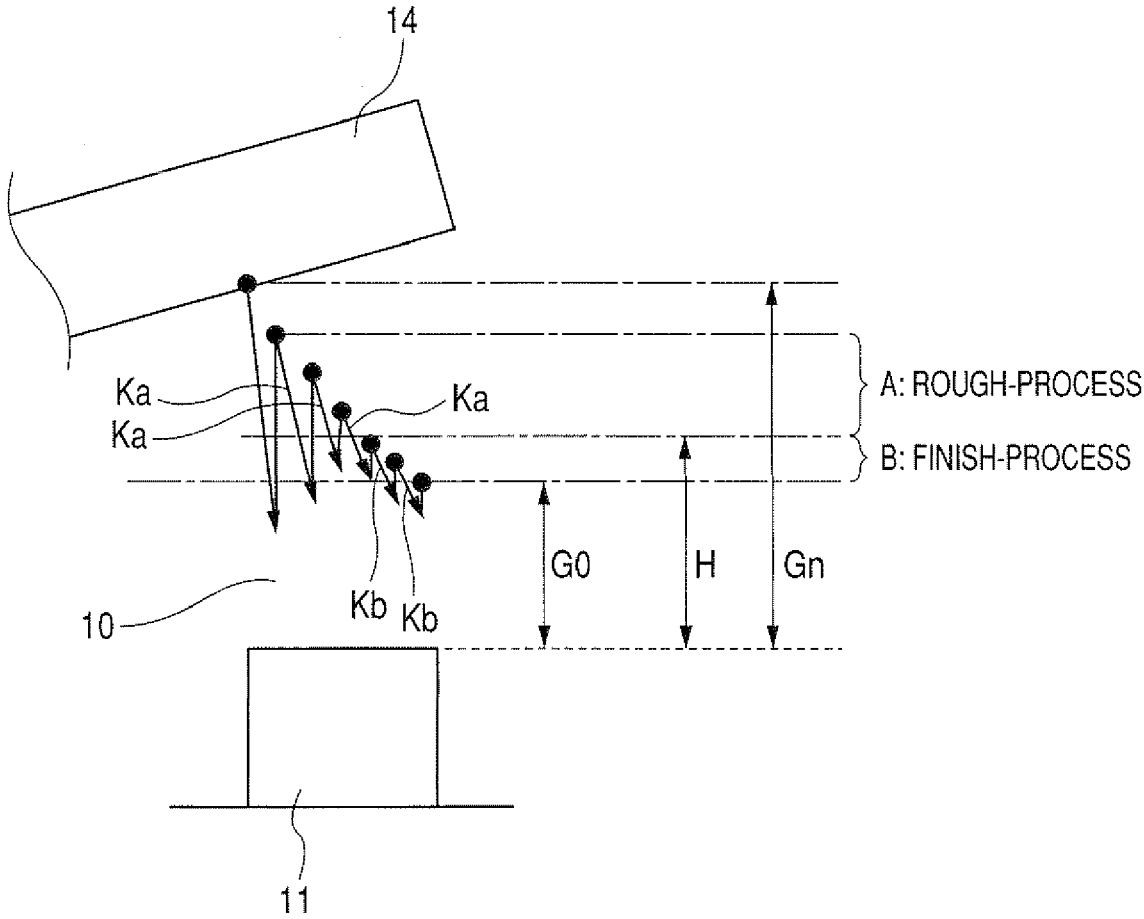
FIG. 1 is a schematic view illustrating a process of adjusting a spark gap in a spark plug according to the first embodiment of invention.

Preferred embodiments of the present invention will be described hereinafter with reference to FIGS. 1-11.

It should be noted that, for the sake of clarity and understanding, identical components having identical functions in different embodiments of the invention have been marked, where possible, with the same reference numerals in each of the figures.

First Embodiment

Referring first to FIGS. 1-7, a method, according to the first embodiment of the invention, of manufacturing a spark plug 1 for an internal combustion engine will be described.

Figure 7:
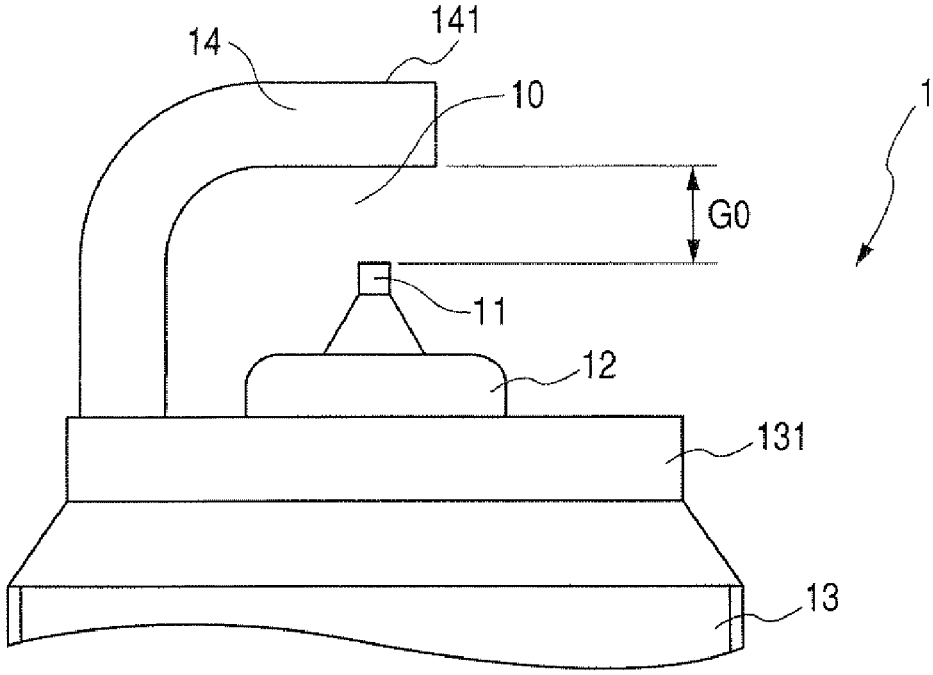
FIG. 7 is a side view showing part of the spark plug around the spark gap.

The spark plug 1 includes, as shown in FIG. 7, a center electrode 11, an insulator 12 that retains therein the center electrode 11, a tubular metal shell 13 that holds therein the insulator 12 along with the center electrode 11, and a ground electrode 14 that is fixed to the metal shell 13 to define a spark gap 10 between itself and the center electrode 11.

Figure 2:
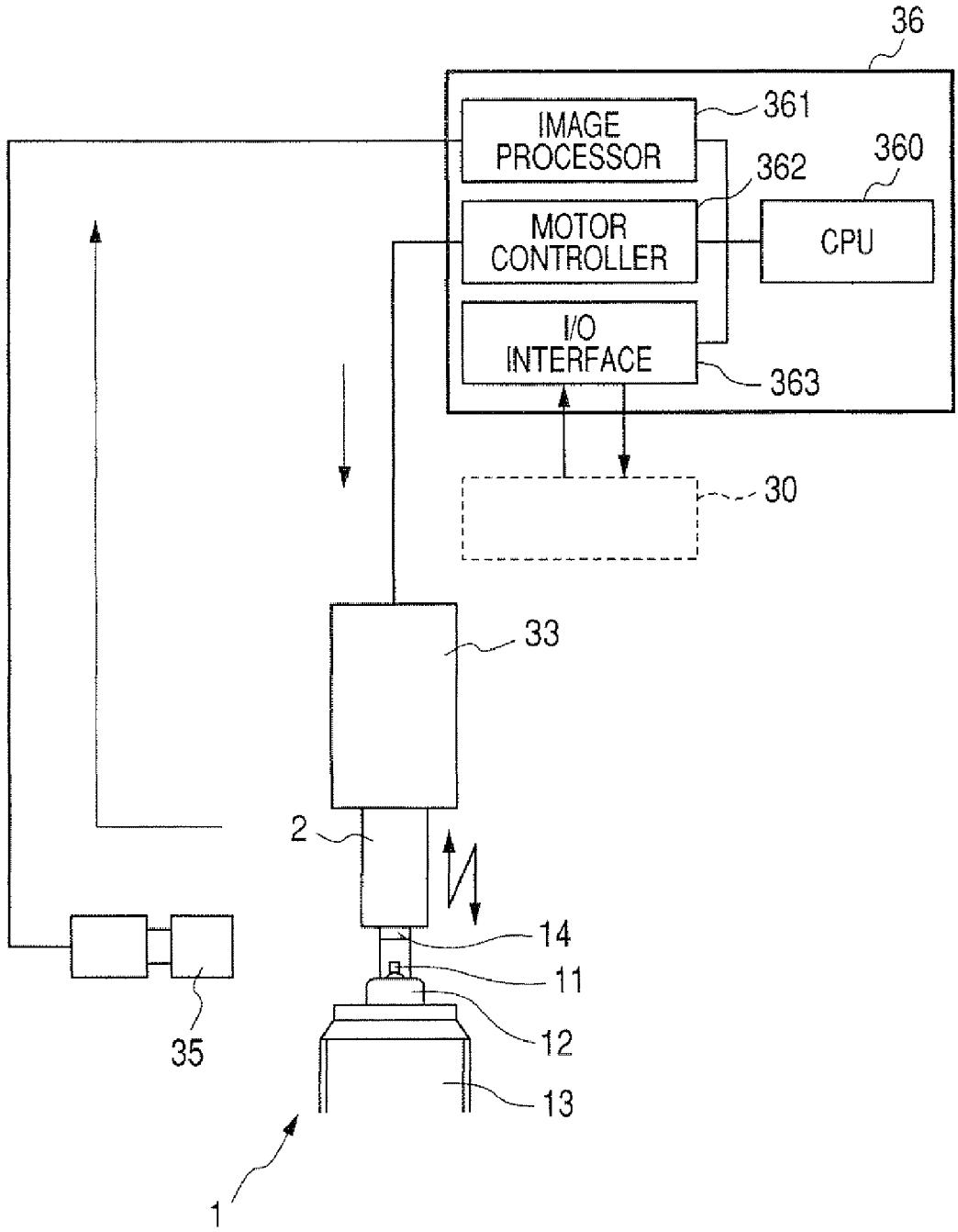
FIG. 2 is a schematic view showing part of a spark gap adjustment system used for adjustment of the spark gap in the spark plug.

In adjusting the size of the spark gap 10, as shown in FIGS. 1 and 2, the ground electrode 14 is repeatedly pressed, by a hammer 2, in the axial direction of the spark plug 1 (i.e., the axial direction of the center electrode 11) toward the center electrode 11 from a state where the size of the spark gap 10 is greater than a predetermined value H. The predetermined value H is greater than a target value (or desired value) G0 of the spark gap 10.

For example, when the spark plug 1 has a thread diameter of M14, the target value G0 may be in the range of 1.00 to 1.10 mm. Further, when the target value G0 is equal to, for example, 1.05 mm, the predetermined value H may be in the range of 1.08 to 1.10 mm.

In the present embodiment, the hammer 2 operates in a first mode when the size of the spark gap 10 falls in a rough-process range A which is above the predetermined value H, and in a second mode when the size of the spark gap 10 falls in a finish-process range B which is between the target value G0 and the predetermined value H. Further, the amount of pressing the ground electrode 14 in any press stroke of the hammer 2 in the second mode is less than the amount of pressing the ground electrode 14 in any press stroke of the hammer 2 in the first mode. Furthermore, the amount of pressing the ground electrode 14 in every press stroke of the hammer 2 in the second mode is equal to a fixed value Kb.

Figure 3:
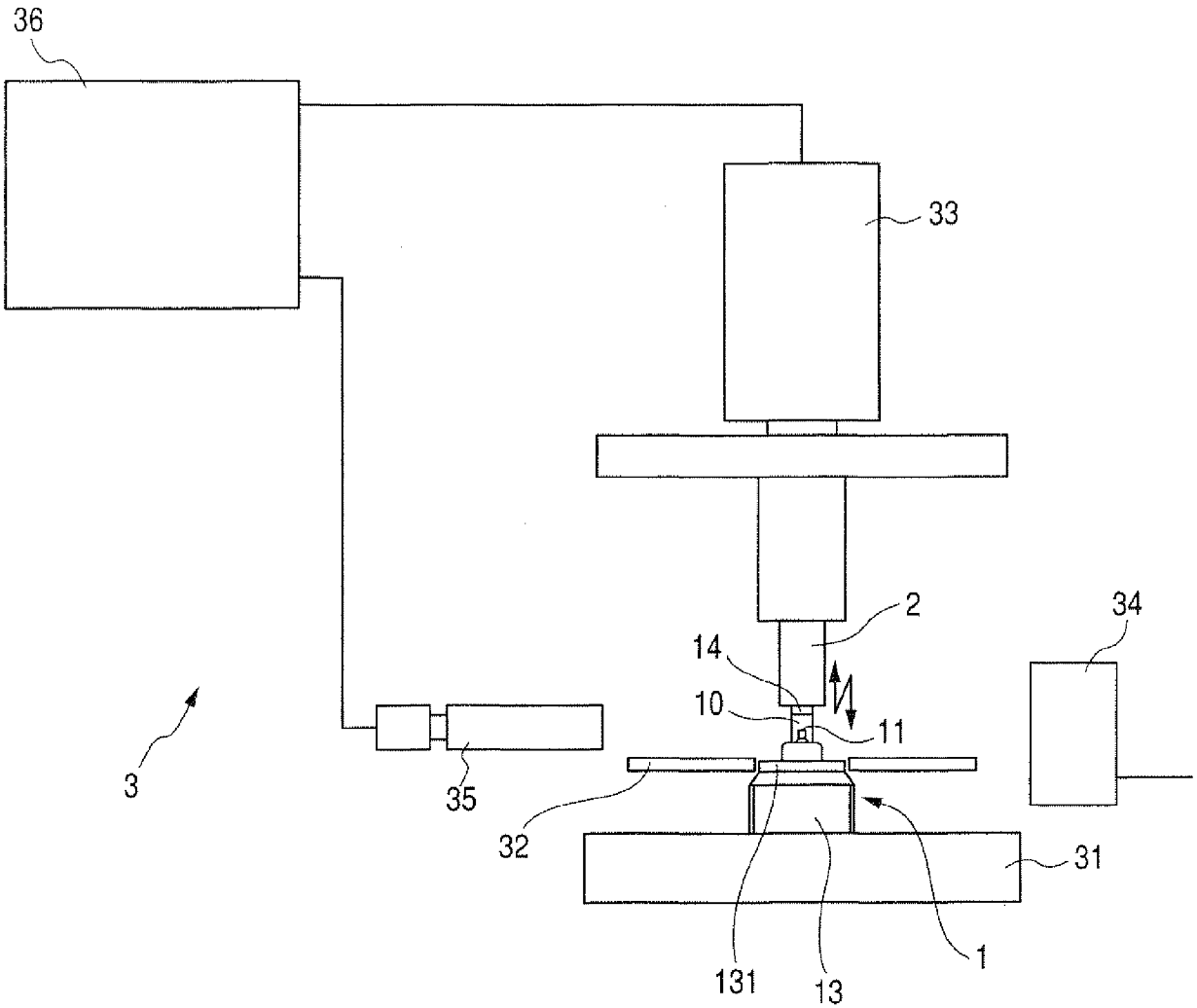
FIG. 3 is a schematic view showing the overall configuration of the spark gap adjustment system.

More specifically, to adjust the spark gap 10, the spark plug 1 is first installed to a spark gap adjustment system 3, as shown in FIG. 3. The spark gap adjustment system 3 includes a holder 31 for holding and carrying the spark plug 1, a positioner 32 for positioning the spark plug 1, the hammer 2 for pressing the ground electrode 14 toward the center electrode 11 of the spark plug 1, a servomotor 33 for actuating the hammer 2, a lighting device 34 for lighting the spark gap 10, a camera 35 for capturing an image of the spark gap 10, and a control device 36 for processing the image captured by the camera 35 and controlling the servomotor 33 based on the information derived from the processed image. In addition, the lighting device 34 may be implemented by an LED lighting device; the camera 35 may be implemented by a CCD camera.

The spark plug 1 is carried to a predetermined position right below the hammer 2 with the metal shell 13 being held by the holder 31. Then, the positioner 2 grips an end portion 131 of the metal shell 13, thereby positioning the spark plug 1 at the predetermined position. The lighting device 34, which is located on one side of the spark gap 10, emits light to the center and ground electrodes 11 and 14 in a radial direction of the spark plug 1 (i.e., in a direction perpendicular to the axial direction of the spark plug 1). The camera 35, which is located on the other side of the spark gap 10 opposite to the lighting device 34, captures an image of the center and ground electrodes 11 and 14 and sends an image signal indicative of the captured image to the control device 36.

The controlling device 36 includes, as shown in FIG. 2, a CPU 360, an image processor 361, a motor controller 362, and an Input/Output (I/O) interface 363. The CPU 360 controls both the image processor 361 and the motor controller 362. The image processor 361 processes the image signal sent from the camera 35 and determines values of parameters, such as the height of the ground electrode 14 and the size of the spark gap 10, based on the processed image signal. Further, based on the values of parameters determined by the image processor 316, the motor controller 362 controls the servomotor 33, thereby controlling the pressing operation of the hammer 2. The I/O interface 363 is provided to input/output data between the controlling device 36 and an external control device 30. In addition, the CPU 360 may be implemented by, for example, a duel-core CPU, so that it can concurrently control the operations of the image processor 361 and the motor controller 362 at high speed.

Figure 4:
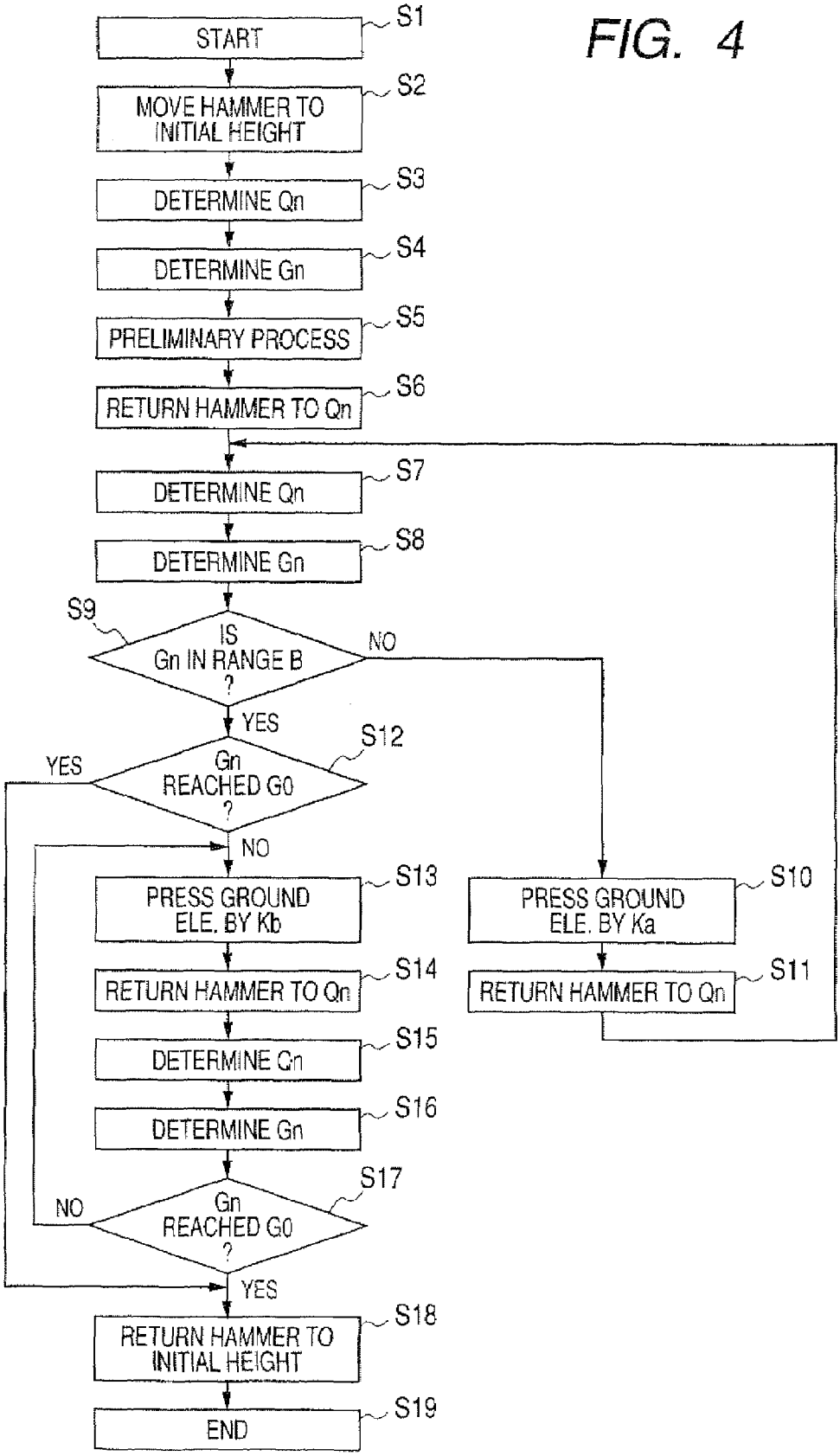
FIG. 4 is a flow chart illustrating the process of adjusting the spark gap in the spark plug according to the first embodiment.

FIG. 4 shows the entire process of adjusting the spark gap 10 in the spark plug 1 according to the present embodiment.

This process starts, in step S1, upon installation of the spark glug 1 to the spark gap adjustment system 3 and transmission of a start command signal from the external control device 30 to the controlling device 36 of the spark gap adjustment system 3.

Figure 5:
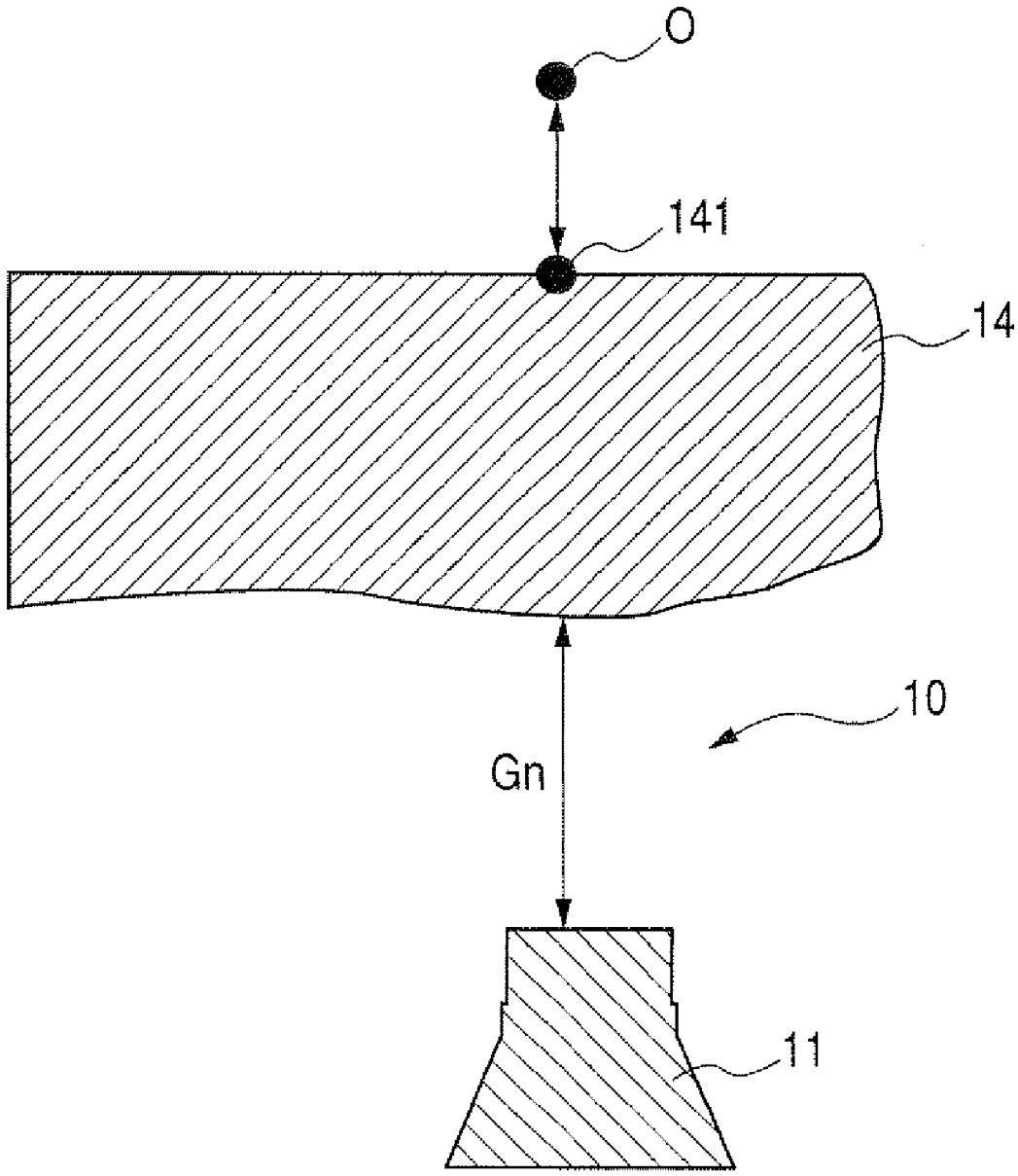
FIG. 5 is a schematic view illustrating the initial height O of a hammer of the spark gap adjustment system in the process of FIG. 4.

In step S2, the hammer 2 is moved, by the servomotor 33, to an initial height O as shown in FIG. 5.

In step S3, the height Qn of an outer side surface 141 of the ground electrode 14 is determined by the controlling device 36. As shown in FIG. 7, the outer side surface 141 faces the opposite side of the ground electrode 14 to the spark gap 10, and is to be pressed by the hammer 2. Hereinafter, the outer side surface 141 is to be simply referred to as pressed surface 141.

In step S4, the current size Gn of the spark gap 10 is determined by the controlling device 36.

In step S5, a preliminary process is performed on the ground electrode 14. Specifically, the hammer 2 is moved down from the initial height O toward the center electrode 11 by a given amount, thereby pressing the ground electrode 14 toward the center electrode 11. The given amount is so given as not to bring the size of the spark gap 10 into the finish-process range B through the preliminary process.

In step S6, the hammer 2 is returned to the height Qn of the pressed surface 141 of the ground electrode 14 before the preliminary process. That is, the hammer 2 is returned only to the height Qn of the pressed surface 141 determined in step S7, but not completely to the initial height O thereof.

In step S7, the height Qn of the pressed surface 141 of the ground electrode 14 is determined by the controlling device 36.

In step S8, the current size Gn of the spark gap 10 is determined by the controlling device 36.

In step S9, a determination is made, by the controlling device 36, as to whether the current size Gn of the spark gap 10 falls in the finish-process range B.

If the determination in step S9 produces a "NO" answer, in other words, if the current size Gn of the spark gap 10 falls in the rough-process range A, then the process proceeds to step S10.

In step S10, the ground electrode 14 is pressed, at the pressed surface 141 by the hammer 2, by an amount Ka toward the center electrode 11. The amount Ka is determined in proportion to the difference between the current size Gn and the target value Go of the spark gap 10. That is, $Ka=\alpha(Gn-G0)$, where $\alpha$ is a preset coefficient. Additionally, $\alpha$ may be preset to, for example, 0.8.

In step S11, the hammer 2 is returned to the height Qn of the pressed surface 141 of the ground electrode 14 before the last press stroke. Then, the process returns to the step S7.

On the other hand, if the determination in step S9 produces a "YES" answer, in other words, if the current size Gn of the spark gap 10 falls in the finish-process range B, then the process proceeds to step S12.

In step S12, a further determination is made, by the controlling device 36, as to whether the current size Gn of the spark gap 10 has reached the target value G0.

If the determination in step S12 produces a "YES" answer, then the process directly proceeds to step S18 without performing steps S13 to S17.

On the contrary, if the determination in step S12 produces a "NO" answer, in other words, if the current size Gn of the spark gap 10 is still greater than the target value G0, then the process goes on to step S13.

In step S13, the ground electrode 14 is pressed, at the pressed surface 141 by the hammer 2, by the fixed amount Kb toward the center electrode 11. The fixed amount Kb, which is less than any of the amounts Ka determined in S10, may be in the range of 5 to 20 μm.

In step S14, the hammer 2 is returned to the height Qn of the pressed surface 141 of the ground electrode 14 before the last press stroke.

In step S15, the height Qn of the pressed surface 141 of the ground electrode 14 is determined by the controlling device 36.

In step S16, the current size Gn of the spark gap 10 is determined by the controlling device 36.

In step S17, a determination is made, by the controlling device 36, as to whether the current size Gn of the spark gap 10 has reached the target value G0.

If the determination in step S17 produces a "NO" answer, then the process returns to step S13. On the contrary, if the determination in step S17 produces a "YES" answer, then the process proceeds to step S18.

In step S18, the hammer 2 is returned to the initial height O thereof. Then, the entire process is terminated in step S19.

Figure 6:
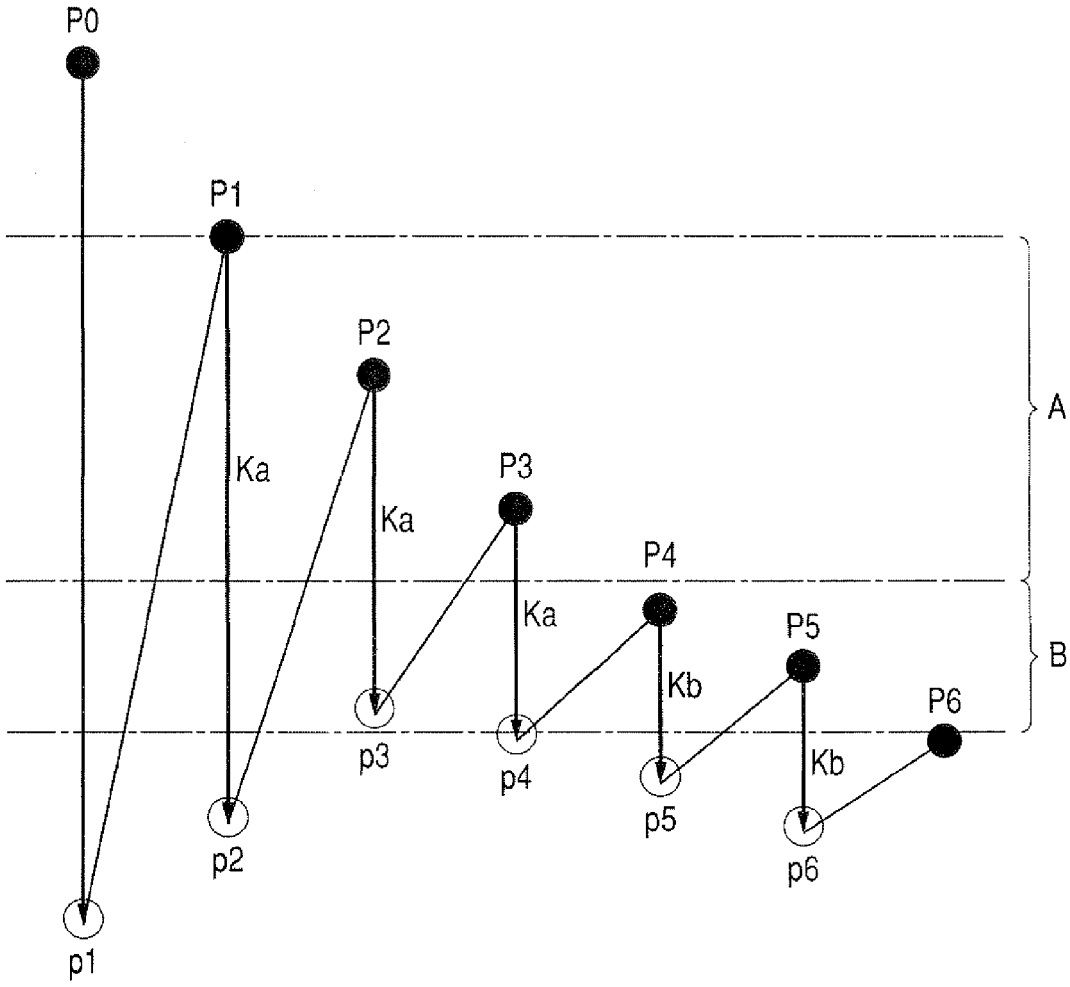
FIG. 6 is a schematic view illustrating the change in height of a ground electrode of the spark plug in the process of FIG. 4.

FIG. 6 shows the change in height of the ground electrode 14 during the above spark gap adjustment process.

In FIG. 6, P0-P6 and p1-p6 denote the heights of that point in the ground electrode 14 which is closest to the center electrode 11 in the axial direction of the spark plug 1. Moreover, in the following explanation, Qn (n=0-6) denote the heights of the pressed surface 141 of the ground electrode 14 which respectively correspond to Pn (n=0-6).

First, the ground electrode 14 is pressed, by the preliminary process (step S5 in FIG. 4), from the height P0 to the height p1. Then, the hammer 2 is returned to the height Q0 (step S6 in FIG. 4), releasing the pressing force against the ground electrode 14. Consequently, the ground electrode 14 springs back to the height P1.

Next, in the rough-process range A of the spark gap 10, the ground electrode 14 is pressed, by an amount Ka (step S10 in FIG. 4), from the height P1 to the height p2. Then, the hammer 2 is returned to the height Q1 (step S11 in FIG. 4), so that the ground electrode 14 springs back to the height P2. By repeatedly pressing the ground electrode 14 in this manner (steps S7-S11 in FIG. 4), the height of that point in the ground electrode 14 which is closest to the center electrode 11 is changed as p3-P3-p4-P4.

From the height P4, the size of the spark gap 10 comes to fall in the finish-process range B. Thus, the ground electrode 14 is pressed, by the fixed amount Kb (step S13 in FIG. 4), from the height P4 to the height p5. Then, the hammer 2 is returned to the height Q4 (step S14 in FIG. 4), so that the ground electrode 14 springs back to the height P5.

Since the size of the spark gap 10 has not yet reached the target value G0 (step S17 in FIG. 4), the ground electrode 14 is pressed again by the fixed amount Kb, from the height P5 to the height p6. Then, the hammer 2 is returned to the height Q5, so that the ground electrode 14 springs back to the height P6.

At the height P6, the size of the spark gap 10 is no longer greater than the target value G0. In other words, the size of the spark gap 10 has reached the target value G0 (step S17 in FIG. 4). Therefore, the hammer 2 is returned to the initial position O thereof (step S18 in FIG. 4), terminating the entire process of adjusting the spark gap 10.

The method of manufacturing the spark plug 1 according to the present embodiment thus includes the steps of: 1) preparing the center electrode 11, the insulator 12, the metal shell 13, and the ground electrode 14; 2) assembling those components 11-14 together, so that the center electrode 11 is retained in the insulator 12, the insulator 12 is held in the metal shell 13 along with the center electrode 11, and the ground electrode 14 is fixed to the metal shell 13 to form the spark gap 10 between the center and ground electrodes 11 and 14; 3) adjusting the size of the spark gap 10 according to the above-described process.

The method of manufacturing the spark plug 1 according to the present embodiment has the following advantages.

In the present embodiment, to adjust the size of the spark gap 10, the hammer 2 selectively operates in one of the first and second modes according to the size of the spark gap 10. More specifically, when the size of the spark gap 10 falls in the rough-process range A, the hammer 2 operates in the first mode in which it repeatedly presses the ground electrode 14 each press stroke by an amount Ka greater than the fixed amount Kb. Further, when the size of the spark gap 10 is decreased to fall in the finish-process range B, the hammer 2 comes to operate in the second mode in which it repeatedly presses the ground electrode 14 each press stroke by the fixed amount Kb.

Accordingly, when the size of the spark gap 10 is in the rough-process range A, it is possible to deform the ground electrode 14 each press stroke by a large amount, thereby bringing the size of the spark gap 10 into the finish-process range B with a small number of reciprocations of the hammer 2. Moreover, after the size of the spark gap 10 has reached the finish-process range B, it is possible to allow the size of the spark gap 10 to gradually approach the target value G0, thereby preventing the size of the spark gap 10 from being decreased below the target value G0 too much.

Further, in the second mode, the hammer 2 repeatedly presses the ground electrode 14 each press stroke by the fixed amount Kb. Therefore, even if the size of the spark gap 10 was decreased below the target value G0 by the last press stroke and the amount of springback of the ground electrode 14 was zero, the final size of the spark gap 10 would deviate from the target value G0 by Kb at the maximum.

Accordingly, even when the amount of springback of the ground electrode 14 varies among individual spark plugs 1, it is still possible to effectively minimize the variation in spark gap size among those spark plugs 1, thereby accurately and effectively adjusting the spark gap 10 in each individual spark plug 1.

In the present embodiment, after each press stroke, the hammer 2 is returned only to the height of the pressed surface 141 of the ground electrode 14 before the press stroke.

Consequently, it is possible to minimize the return stroke of the hammer 2 without restricting the springback of the ground electrode 14 after the press stroke. As a result, it is possible to improve the productivity without decreasing the accuracy in adjustment of the spark gap 10.

In the present embodiment, in the first mode, the hammer 2 repeatedly presses the ground electrode 14 each press stroke by an amount Ka that is determined in proportion to the difference between the size of the spark gap 10 at the start of the press stroke and the target value G0.

Consequently, it is possible to minimize the number of reciprocations of the hammer 2 necessary for bringing the size of the spark gap 10 into the finish-process range B, while reliably preventing the size of the spark gap 10 from being decreased below the target value G0 too much.

Second Embodiment

This embodiment illustrates a method of manufacturing the spark plug 1, which is almost the same as the method according to the first embodiment. Accordingly, only the difference between the two methods will be described hereinafter.

In the first embodiment, as described previously, the hammer 2 repeatedly presses, in the second mode, the ground electrode 14 each press stroke by the fixed amount Kb.

In comparison, in the present embodiment, the hammer 2 repeatedly presses, in the second mode, the ground electrode 14 in such a manner that the difference between the minimum heights of the ground electrode 14 in every two consecutive press strokes is equal to a fixed value.

Figure 8:
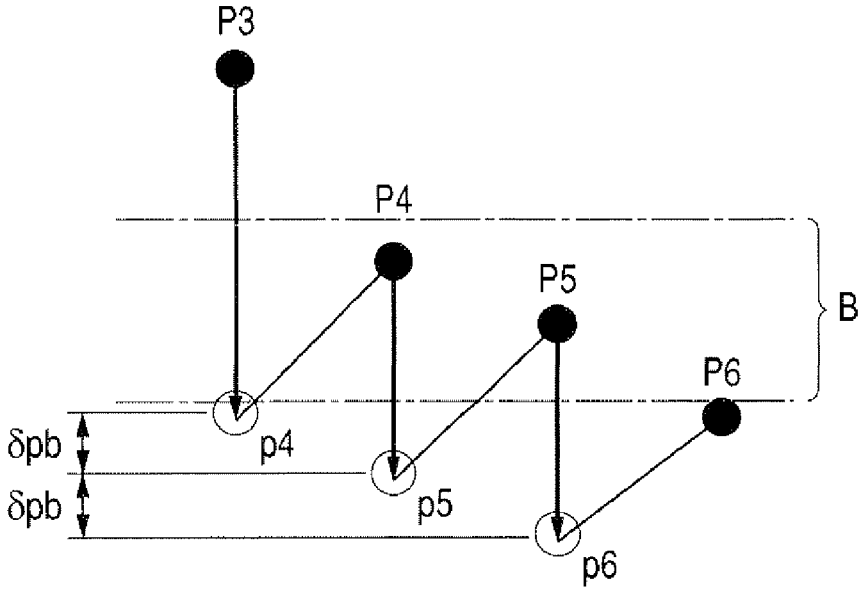
FIG. 8 is a schematic view illustrating a process of adjusting a spark gap in a spark plug according to the second embodiment of invention.

More specifically, referring to FIG. 8, in the last press stroke in the first mode, the hammer 2 presses the ground electrode 14 from the maximum height P3 to the minimum height p4.

After entering the second mode, in the first press stroke, the hammer 2 presses the ground electrode 14 from the maximum height P4 to the minimum height p5. The difference between the minimum heights p4 and p5 of the ground electrode 14 is equal to a fixed value δ pb. In addition, the fixed value δ pb may be in the range of 0.005 to 0.020 mm.

Further, in the second press stroke in the second mode, the hammer 2 presses the ground electrode 14 from the maximum height P5 to the minimum height p6. The difference between the minimum heights p5 and p6 of the ground electrode 14 is also equal to the fixed value δ pb.

After the second press stroke in the second mode, the ground electrode 14 springs backs from the height p6 to the height P6, making the size of the spark gap 10 reach the target value G0.

As above, in the present embodiment, when the size of the spark gap 10 is decreased to fall in the finish-process range B, the hammer 2 comes to operate in the second mode in which it repeatedly presses the ground electrode 14 such that the difference between the minimum heights of the ground electrode 14 in every two consecutive press strokes is equal to the fixed value δ pb.

Consequently, even if the size of the spark gap 10 was decreased below the target value G0 by the last press stroke and the amount of springback of the ground electrode 14 was zero, the final size of the spark gap 10 would deviate from the target value G0 only by a limited value.

Accordingly, even when the amount of springback of the ground electrode 14 varies among individual spark plugs 1, it is still possible to minimize the variation in spark gap size among those spark plugs 1, thereby accurately adjusting the spark gap 10 in each individual spark plug 1.

Third Embodiment

This embodiment illustrates a method of manufacturing the spark plug 1, which is almost the same as the method according to the first embodiment. Accordingly, only the difference between the two methods will be described hereinafter.

In the first embodiment, as described previously, the hammer 2 repeatedly presses, in the first mode, the ground electrode 14 each press stroke by the amount Ka that is determined in proportion to the difference between the size of the spark gap 10 at the start of the press stroke and the target value G0.

In comparison, in the present embodiment, the hammer 2 repeatedly presses, in the first mode, the ground electrode 14 in such a manner that the difference between the minimum heights of the ground electrode 14 in every two consecutive press strokes is proportional to the difference between the size of the spark gap 10 at the start of the latter one of the two consecutive press strokes and the target value G0.

Figure 9:
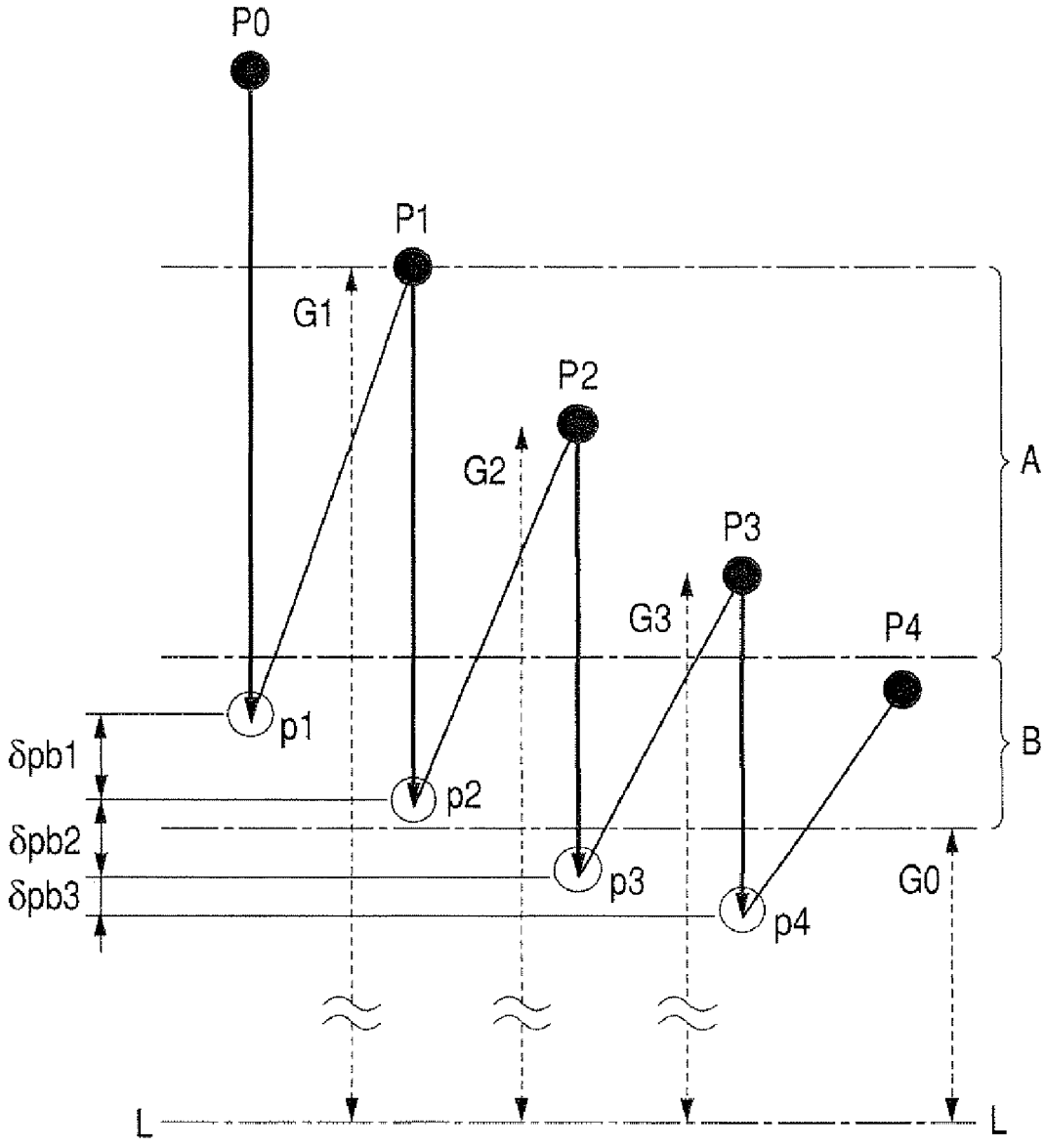
FIG. 9 is a schematic view illustrating a process of adjusting a spark gap in a spark plug according to the third embodiment of invention.

More specifically, referring to FIG. 9, in the press stroke of the preliminary process, the hammer 2 presses the ground electrode 14 from the maximum height P0 to the minimum height p1.

After entering the first mode, in the first press stroke, the hammer 2 presses the ground electrode 14 from the maximum height P1 to the minimum height p2. The difference δ pa1 between the minimum heights p1 and p2 of the ground electrode 14 is equal to β (G1−G0), where β is a preset coefficient, G1 is the size of the spark gap 10 at the start of the first press stroke, and G0 is the target value.

In addition, the coefficient β may be in the range of 0.1 to 1.0. Moreover, in FIG. 9, the chain line L-L represents the height of the tip of the center electrode 11.

Further, in the second press stroke in the first mode, the hammer 2 presses the ground electrode 14 from the maximum height P2 to the minimum height p3. The difference δ pa2 between the minimum heights p2 and p3 of the ground electrode 14 is equal to β (G2−G0), where G2 is the size of the spark gap 10 at the start of the second press stroke.

Furthermore, in the third press stroke in the first mode, the hammer 2 presses the ground electrode 14 from the maximum height P3 to the minimum height p4. The difference δ pa3 between the minimum heights p3 and p4 of the ground electrode 14 is equal to β (G3−G0), where G3 is the size of the spark gap 10 at the start of the third press stroke.

After the third press stroke in the first mode, the ground electrode 14 springs back from the height p4 to the height P4, bringing the size of the spark plug 10 into the finish-process range B.

As above, in the present embodiment, when the size of the spark gap 10 falls in the rough-process range A, the hammer 2 operates in the first mode in which it repeatedly presses the ground electrode 14 such that the difference between the minimum heights of the ground electrode 14 in every two consecutive press strokes is proportional to the difference between the size of the spark gap 10 at the start of the latter one of the two consecutive press strokes and the target value G0.

Consequently, as in the first embodiment, it is possible to minimize the number of reciprocations of the hammer 2 necessary for bringing the size of the spark gap 10 into the finish-process range B, while reliably preventing the size of the spark gap 10 from being decreased below the target value G0 too much.

COMPARATIVE EXAMPLE

Figure 10:
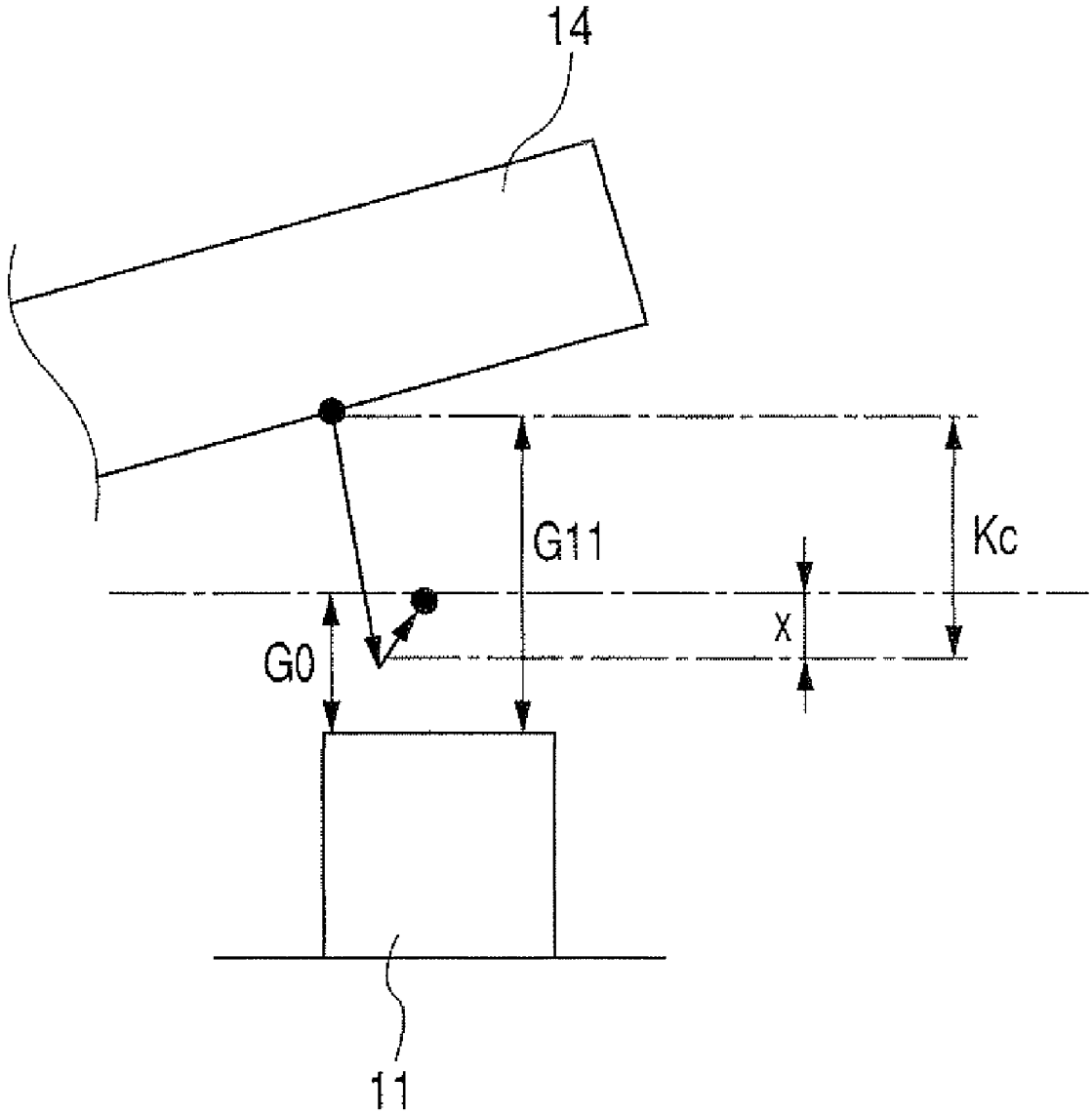
FIG. 10 is a schematic view illustrating a conventional process of adjusting a spark gap in a spark plug.

FIG. 10 illustrates a conventional process of adjusting the spark gap 10. According to this process, the hammer 2 presses the ground electrode 14 toward the center electrode 11 by an amount that is determined based on a prediction of the amount of springback of the ground electrode 14.

More specifically, let Kc represent the amount by which the hammer 2 presses the ground electrode 14 toward the center electrode 11, x represent the predicted amount of springback of the ground electrode 14, and G1 represent the initial size of the spark gap 10. Then, the amount Kc is determined by the following equation:

$$Kc=G11-G0+x.$$

Figure 11:
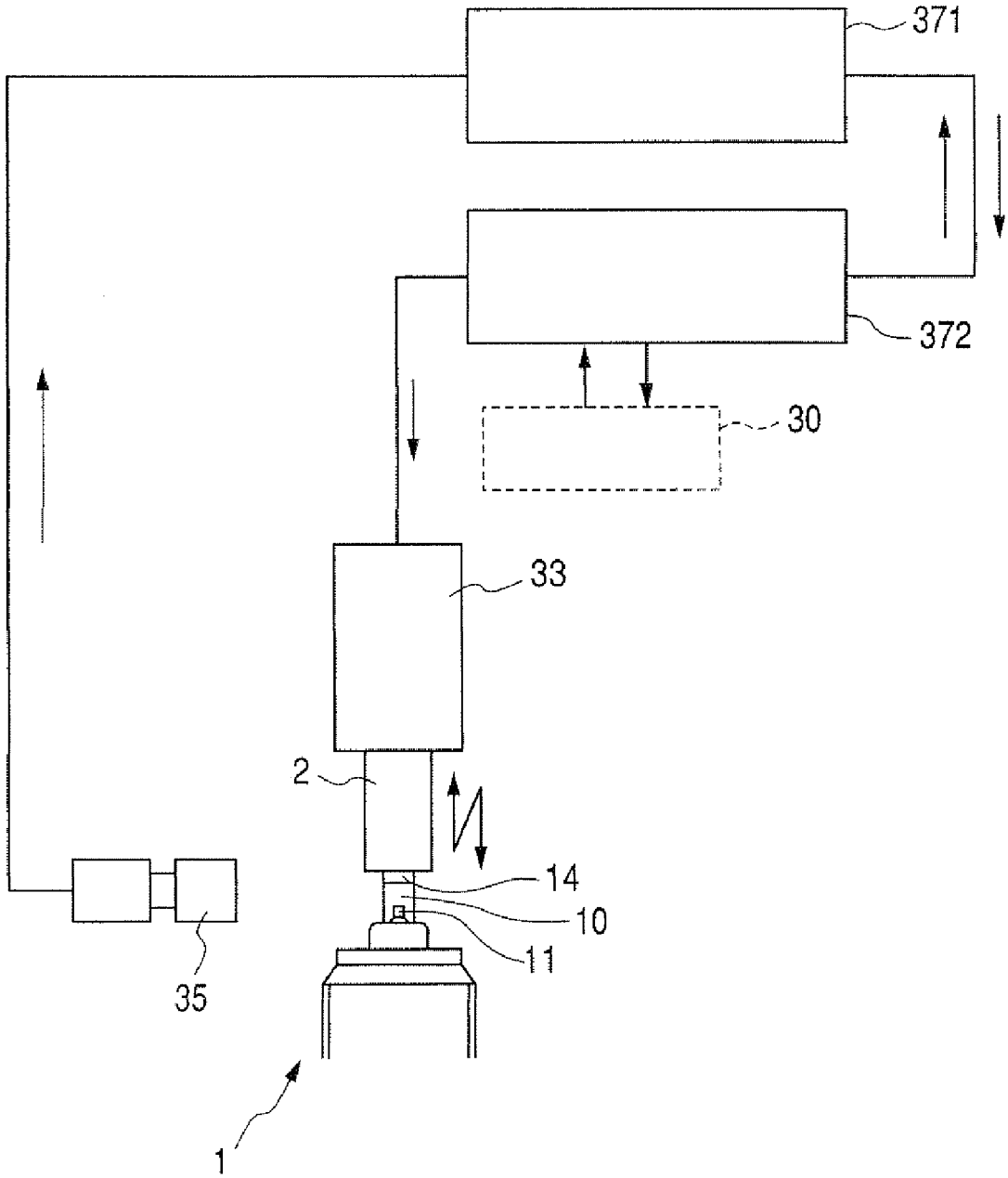
FIG. 11 is a schematic view illustrating the overall configuration of a conventional spark gap adjustment system used for implementation of the conventional process.

FIG. 11 shows the overall configuration of a conventional spark gap adjustment system used for implementation of the conventional process. As shown, the conventional system includes the hammer 2 for pressing the ground electrode 14 toward the center electrode 11, the servomotor 33 for actuating the hammer 2, a motor controller 372 for controlling the servomotor 33, the camera 35 for capturing an image of the spark gap 10, and an image processor 371 for processing the image captured by the camera 35.

The conventional process starts upon transmission of a start command signal from the external control device 30 to the motor controller 372. Then, the motor controller 372 sends a command signal to the image processor 371. Upon receipt of the command signal, the image processor 371 processes the image captured by the camera 35, determines the initial size G11 of the spark gap 10 based on the processed image, determines the amount Kc based on G11, x, and G0 as described above, and sends the motor controller 372 a signal representative of the determined amount Kc. Based on the signal, the motor controller 372 controls the servomotor 33 to actuate the hammer 2, thereby enabling the hammer 2 to press the ground electrode 14 by the amount Kc.

With the above conventional process, when the actual amount of springback of the ground electrode 14 agrees with the predicted amount x, the final size of the spark gap 10 also agrees with the target value G0. However, when the actual amount of springback of the ground electrode 14 is less than the predicted amount X, the final size of the spark gap 10 is also less than the target value G0.

Accordingly, when the amount of springback of the ground electrode 14 varies among the individual spark plugs 1, the spark gap 10 may be formed too small in some spark plugs 1. Therefore, with the conventional process, it is difficult accurately adjust the spark gap 10 in each individual spark plug 10.

In comparison, with the spark plug manufacturing methods according to the previous embodiments of the invention, even when the amount of springback of the ground electrode 14 varies among the individual spark plugs 1, it is still possible to accurately and effectively adjust the spark gap 10 in each individual spark plug 10.

In addition, in the conventional spark gap adjustment system, the image processor 371 and the motor controller 372 are separately provided. Accordingly, a relatively long time is necessary for communication between the image processor 371 and the motor controller 372, lowering the productively. In comparison, in the spark gap adjustment system 3 according to the previous embodiments, both the image processor 361 and the motor controller 362 are integrated into the single control device 36 and controlled by the common high-speed CPU 360. Accordingly, the time necessary for communication between the image processor 361 and the motor controller 362 is shortened, improving the productivity.

While the above particular embodiments of the invention and comparative example have been shown and described, it will be understood by those skilled in the art that various modifications, changes, and improvements may be made without departing from the spirit of the invention.

For example, in the previous embodiments, the hammer 2 enters the first mode only after performing the preliminary process. However, it is also possible for the hammer 2 to directly enter the first mode without performing the preliminary process.

What is claimed is:

1. A method of manufacturing a spark plug for an internal combustion engine, the method comprising the steps of:

(a) preparing a tubular metal shell, an insulator, a center electrode, and a ground electrode;

(b) assembling the metal shell, the insulator, and the center and ground electrodes together, so that the metal shell holds therein the insulator, the center electrode is secured in the insulator, and the ground electrode is fixed to the metal shell to form a spark gap between the center and ground electrodes; and (c) adjusting the spark gap to bring the size of the spark gap into agreement with a target value, wherein in the step (c), the ground electrode is repeatedly pressed, by a hammer, toward the center electrode from a state where the size of the spark gap is greater than a predetermined value that is greater than the target value, the hammer operates in a first mode when the size of the spark gap falls in a rough-process range which is above the predetermined value, and in a second mode when the size of the spark gap falls in a finish-process range which is between the target value and the predetermined value, and the amount of pressing the ground electrode in any press stroke of the hammer in the second mode is less than the amount of pressing the ground electrode in any press stroke of the hammer in the first mode, wherein the amount of pressing the ground electrode in every press stroke of the hammer in the second mode is equal to a fixed value, and wherein in both the first and second modes, the hammer is returned, after each press stroke, to a return position, and all the return positions of the hammer are different from one another.

2. The method as set forth in claim 1, wherein the return position of the hammer after each press stroke is set to the position of a pressed surface of the ground electrode before the press stroke.

3. The method as set forth in claim 1, wherein in each press stroke of the hammer in the first mode, the amount of pressing the ground electrode is proportional to the difference between the size of the spark gap at the start of the press stroke and the target value.

4. The method as set forth in claim 1, wherein the difference between the closest positions of the ground electrode to the center electrode in every two consecutive press strokes of the hammer in the first mode is proportional to the difference between the size of the spark gap at the start of the latter one of the two consecutive press strokes and the target value.

5. A method of manufacturing a spark plug for an internal combustion engine, the method comprising the steps of:

(a) preparing a tubular metal shell, an insulator, a center electrode, and a ground electrode;

(b) assembling the metal shell, the insulator, and the center and ground electrodes together, so that the metal shell holds therein the insulator, the center electrode is secured in the insulator, and the ground electrode is fixed to the metal shell to form a spark gap between the center and ground electrodes; and (c) adjusting the spark gap to bring the size of the spark gap into agreement with a target value, wherein in the step (c), the ground electrode is repeatedly pressed, by a hammer, toward the center electrode from a state where the size of the spark gap is greater than a predetermined value that is greater than the target value, the hammer operates in a first mode when the size of the spark gap falls in a rough-process range which is above the predetermined value, and in a second mode when the size of the spark gap falls in a finish-process range which is between the target value and the predetermined value, and the amount of pressing the ground electrode in any press stroke of the hammer in the second mode is less than the amount of pressing the ground electrode in any press stroke of the hammer in the first mode, wherein the difference between the closest positions of the ground electrode to the center electrode in every two consecutive press strokes of the hammer in the second mode is equal to a fixed value, and wherein in both the first and second modes, the hammer is returned, after each press stroke, to a return position, and all the return positions of the hammer are different from one another.

6. The method as set forth in claim 5, wherein the return position of the hammer after each press stroke is set to the position of a pressed surface of the ground electrode before the press stroke.

7. The method as set forth in claim 5, wherein in each press stroke of the hammer in the first mode, the amount of pressing the ground electrode is proportional to the difference between the size of the spark gap at the start of the press stroke and the target value.

8. The method as set forth in claim 5, wherein the difference between the closest positions of the ground electrode to the center electrode in every two consecutive press strokes of the hammer in the first mode is proportional to the difference between the size of the spark gap at the start of the latter one of the two consecutive press strokes and the target value.

* * * * *